US006301729B1

(12) United States Patent
Hall

(10) Patent No.: US 6,301,729 B1
(45) Date of Patent: Oct. 16, 2001

(54) CRIB SAFETY SACK

(75) Inventor: Maureen Hall, Port Perry (CA)

(73) Assignee: Hotel & Leisure Living Services Ltd., Port Perry (CA)

( * ) Notice: Subject to any disclaimer, the term of this patent is extended or adjusted under 35 U.S.C. 154(b) by 0 days.

(21) Appl. No.: 09/643,831

(22) Filed: Aug. 18, 2000

(51) Int. Cl.[7] ..... A47G 9/04; A47D 15/00
(52) U.S. Cl. ..... 5/494; 5/482; 5/922
(58) Field of Search ..... 5/494, 482, 655, 5/922, 923; 128/872, 873, 869, 870; 2/69, 69.5

(56) References Cited

U.S. PATENT DOCUMENTS

| | | | | |
|---|---|---|---|---|
| 1,863,256 | * | 6/1932 | Snoddy | 5/494 |
| 2,627,617 | * | 2/1953 | Avila | 5/494 |
| 2,677,137 | | 5/1954 | Bergin . | |
| 2,720,661 | * | 10/1955 | Harris | 5/494 |
| 2,729,831 | | 1/1956 | Fuld et al. . | |
| 2,851,703 | * | 9/1958 | Greco | 5/494 |
| 3,570,026 | | 3/1971 | Allison . | |
| 3,845,513 | | 11/1974 | Hubner | 2/69.5 |
| 4,202,052 | | 5/1980 | Bilanzich | 5/498 |
| 5,014,376 | * | 5/1991 | Doran et al. | 5/494 |
| 5,153,954 | | 10/1992 | Ohman | 5/494 |
| 5,509,156 | * | 4/1996 | Smith | 5/482 |
| 5,551,108 | * | 9/1996 | Butler, III | 5/655 |

* cited by examiner

*Primary Examiner*—Alexander Grosz
(74) *Attorney, Agent, or Firm*—Renner, Kenner, Greive, Bobak, Taylor & Weber

(57) ABSTRACT

A crib safety sack made of thin blanket fabric is provided. The sack is pocket-shaped to cover an end of a crib mattress. The top panel of the sack secures an infant in a back sleeping position on the surface of the crib mattress, which is the sleeping position recommended by experts for the prevention of SIDS. The sack acts as a blanket and also as a safety restraint keeping the infant securely in position through gentle force. The sack may be reversible, in that either a top or bottom panel of the sack may be positioned on top of the mattress. The sack preferably has at least one flap providing easy access.

10 Claims, 5 Drawing Sheets

CRIB SAFETY SACK

FIELD OF THE INVENTION

The present invention relates to infant crib bedding, and more particularly to infant blankets for use in cribs.

BACKGROUND OF THE INVENTION

Baby blankets and coverings are well known. Since baby blankets are intended, foremost, to keep a sleeping infant warm, it has long been an objective of blanket designers to develop a blanket which will resist kicking off by a moving infant.

In the past, attempts to develop kick-off resistant infant blankets have yielded various methods of attaching a sheet or blanket to a crib mattress (U.S. Pat. No. 2,677,137 to Bergin, U.S. Pat. No. 2,729,831 to Fuld & Craig) or to the crib bumper pads (U.S. Pat. No. 5,153,954 to Ohman). Various types of infant jackets and fitted garments have been provided to be attached to crib sheets and blankets (U.S. Pat. No. 3,845,513 to Hubner, U.S. Pat. No. 4,202,052 to Bilanzich). The inventions are directed to maintaining the warmth of infants while sleeping.

Much more is known today about infant sleeping patterns. Concern for the warmth and comfort of the sleeping infant is now shared with a concern for the safety of the infant while sleeping. Since babies are known to frequently change position while sleeping, it is desirable to make the sleeping environment as free as possible of suffocation and injury risks and to keep the baby in a secure sleeping position within that environment.

Sudden Infant Death Syndrome (SIDS), sometimes referred to as "crib death", refers to the sudden and unexpected death of an apparently healthy infant usually less than one year of age, which remains unexplained after a thorough investigation. It is estimated that 3 infants per week die of SIDS in Canada (Canadian Paediatric Society, 1999). The American Academy of Pediatrics has reported that SIDS is responsible for more infant deaths in the US than any other cause of death during infancy beyond the neonatal period (American Academy of Pediatrics, 2000).

Although the exact causes of SIDS are unknown, various risk factors have been consistently identified. These factors include, prone (tummy) sleeping, and sleeping on soft bedding surfaces. Health organizations in Canada and the US now recommend that babies be put to sleep on their backs to reduce the risk of SIDS.

Furthermore, it is recommended that firm, flat bedding be used with normal healthy infants, with sheets and light blankets as needed. Soft bedding, such as pillows, comforters, bumper pads, lambskins and similar products, is not recommended due to the risk of suffocation.

Therefore, it is desirable to provide a bedding product which not only keeps the infant snug and warm while sleeping, but also promotes a secure back sleeping position within the crib environment. At the same time, it is desirable to avoid the suffocation risks associated with overly fluffy or soft bedding. A streamlined bedding product should also be resistant to displacement or disengagement from the crib mattress by the infant in the course of ordinary sleeping patterns.

SUMMARY OF THE INVENTION

The present invention provides a crib safety sack for securing an infant in a back sleeping position on a crib mattress.

According to an aspect of the present invention, a crib safety sack for securing an infant in a back sleeping position on a crib mattress is disclosed. The sack comprises a fabric sack including a top panel fastened to a bottom panel. The panels (which are preferably fastened together by sewing) form a pocket adapted to fit securely over part of the infant lying at an end of the crib mattress. The top panel exerts a gentle force on the infant so as to prevent rollover. To ensure a snug fit and adequate pressure on the infant to prevent rollover, the sack preferably comprises a pocket which wraps entirely around the foot end of the mattress and is substantially the same size as the end of the crib mattress to be covered.

Although the preferred embodiment of the sack is for infant use in a crib setting, as a blanket alternative, the sack may also have application on larger child- or adult-size beds.

The sack is preferably fastened on three sides by two downwardly extending side panels and a downwardly extending foot panel.

In a preferred embodiment of the sack, the sack comprises a stretchable fabric. The sack may comprise a fleece fabric, such as polar fleece, or any suitable non-quilted (non-fluffy) blanket material. Where regulations exist requiring infant bedding to be treated for flammability, the sack will preferably be treated to meet or exceed the appropriate standard, such as that set by the American Society for Testing and Materials, "Standard Method of Test for Flammability of Clothing Textiles".

In a preferred embodiment of the sack, to facilitate access, the sack comprises at least one opening flap. The flap comprises a slit extending lengthwise from an open top edge of the sack to a closed bottom edge of the sack. Two overlapping edges of the slit are resealably closeable by a fastening means. The fastening means preferably comprises one or more pairs of strips of hook and loop tape, such as Velcro® hook and loop tape. However, the fastening means may alternatively comprise snaps, fabric or string ties, buttons or any other suitable means. The fastening means preferably allows for a range of closed sizes, allowing the sack to be extended to accommodate a growing child. The sack may comprise two opening flaps, positioned on opposite panels of the sack, such as the top and bottom panels of the sack.

In another preferred embodiment of the sack, the sack is rotatably reversible around the foot end of the crib mattress, about a horizontal axis defined by a head end and a foot end of the crib mattress. When the sack is flipped over (by tugging the sack reversibly around the end of the mattress, or by removing the sack and replacing it on the mattress in the reverse position), the relative top and bottom panels of the sack may be reversed. Alternatively, the entire mattress may be flipped over with the sack in place to achieve a similar effect. It is preferred to make the sack reversible in order to extend the usefulness of the blanket between washings. If the infant wets or soils one side of the sack, the sack is reversible so that the infant may be covered by a dry side of the sack.

According to another aspect of the present invention, a method of securing an infant in a back sleeping position on a crib mattress is disclosed. The method comprises two steps:

(a) covering an end of a crib mattress with a crib safety sack; and (b) tucking a foot end of an infant between a top panel of the crib safety sack and a top surface of the crib mattress.

Within the crib safety sack, the infant is secured on the infant's back with his or her head, shoulders and arms remaining exposed. The crib safety sack exerts a gentle force on the infant to prevent rollover.

According to another aspect of the present invention, a method of securing an infant in a back sleeping position on a crib mattress is disclosed. The method comprises four steps:

(a) opening at least one flap on a crib safety sack;

(b) covering an end of a crib mattress with the crib safety sack;

(c) tucking a foot end of an infant between a top panel of the crib safety sack and a top surface of the crib mattress; and (d) closing the at least one flap securing the infant on the infant's back under the top panel of the crib safety sack.

The infant is secured by the crib safety sack on the infant's back on the surface of the crib mattress with his or her head, shoulders and arms remaining exposed. The crib safety sack exerts a gentle force on the infant to prevent rollover. The flap permits easy removal and reversal of the sack, as well as, access to the infant occupant.

BRIEF DESCRIPTION OF THE DRAWINGS

Embodiments of the invention will be described by reference to the drawings in which.

DETAILED DESCRIPTION

Figure 1:
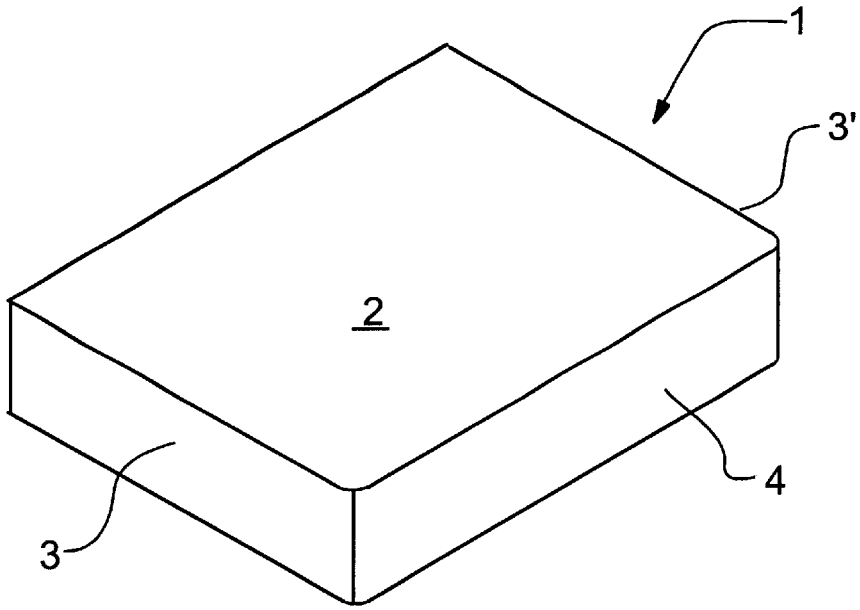
FIG. 1 is a top perspective view of a crib safety sack according to the present invention.
Figure 1A:
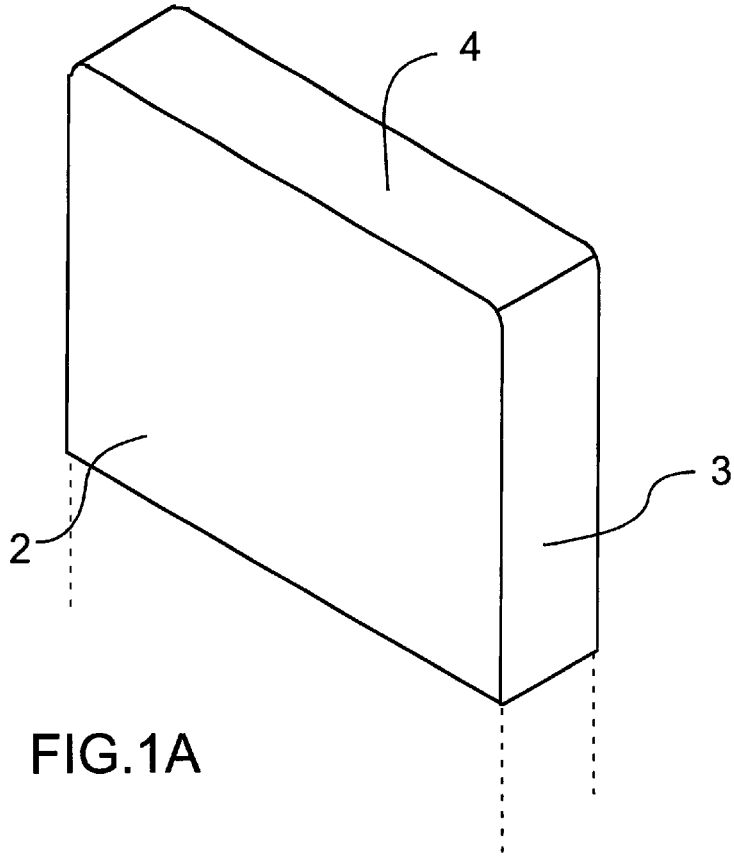
FIG. 1A is a side perspective view of the crib safety sack.
Figure 2A:
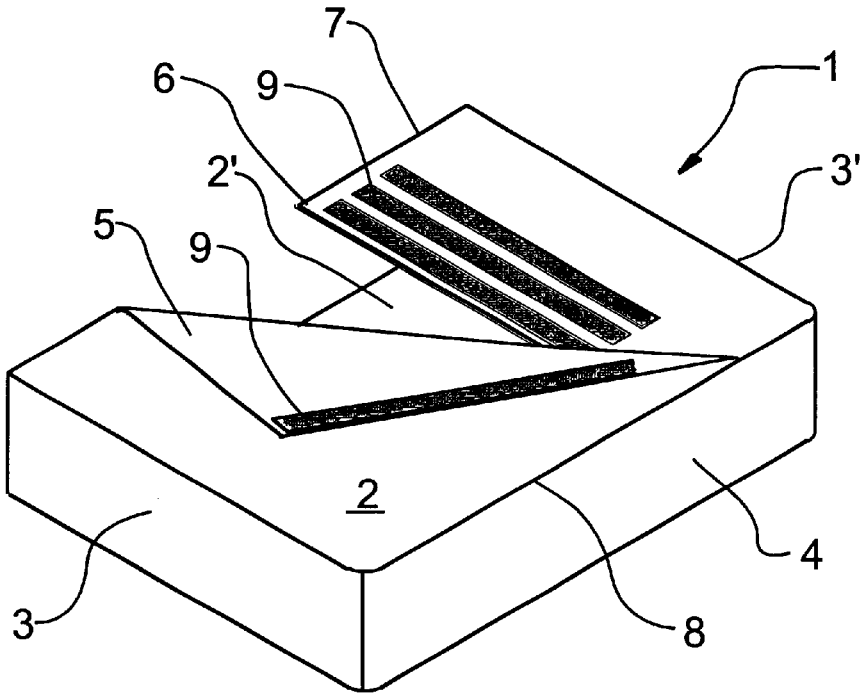
FIG. 2A is a top perspective view of a preferred embodiment of the sack with a flap (shown in flap open position)
Figure 2B:
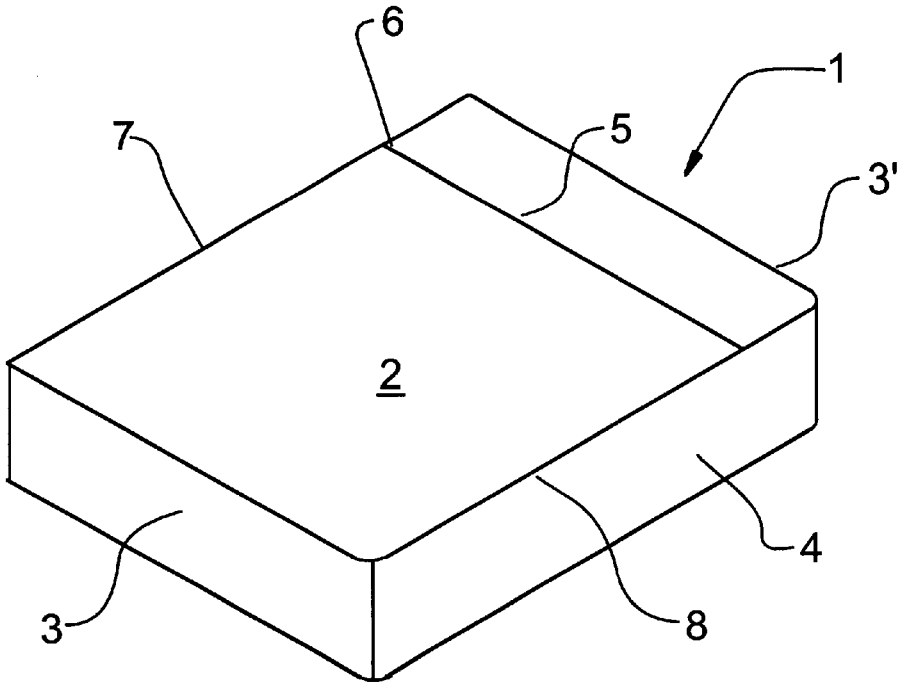
FIG. 2B is a top perspective view of the preferred embodiment (shown in flap closed position)
Figure 3:
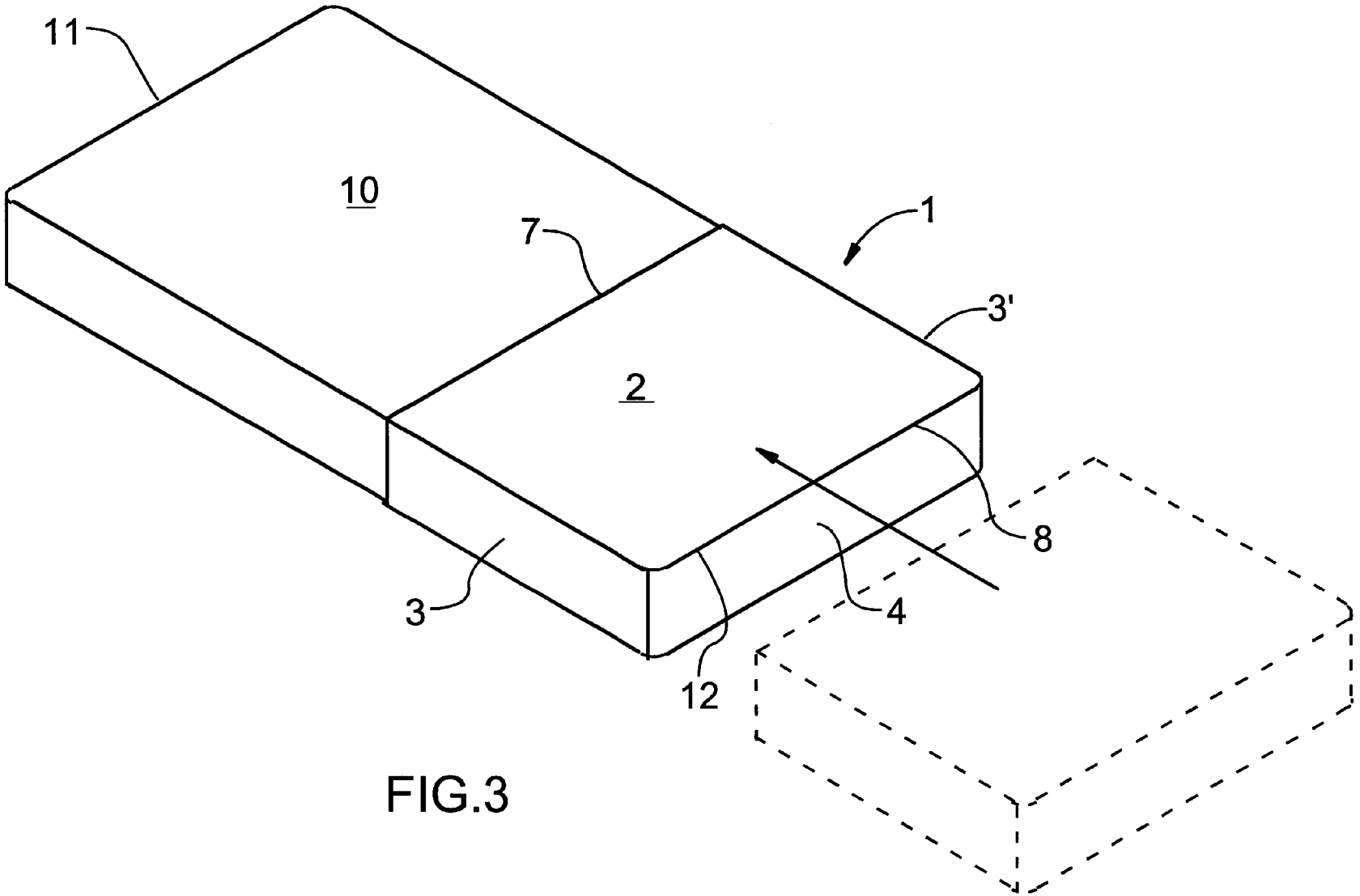
FIG. 3 is a top perspective view of a crib safety sack on a crib mattress.

FIGS. 1–3 show perspective views of a crib safety sack 1. The sack 1 is comprised of fabric, preferably stretchable and preferably sewn into a pocket shape. Although the preferred shape of the sack is a pocket adapted to enclose an end of a crib mattress, it is not intended to exclude partial enclosure configurations, such as a fabric frame. The sack 1 may be comprised of fleece fabric, such as polar fleece, or any other suitable non-quilted (non-fluffy) blanket material. Quilted and fluffy fabrics are not desirable due to the risk of the infant suffocating if ever face down on the fabric.

In the preferred embodiment, the pocket has a top panel 2, which is fastened (preferably, sewn) to a bottom panel 2' (shown in FIG. 2A) by two downwardly extending side panels 3, 3' and a downwardly extending foot panel 4.

The pocket is adapted to fit securely over part of an infant lying at the end of a crib mattress. The top panel 2 exerts a gentle force on the infant so as to prevent rollover. The sack thereby secures the infant in a back sleeping position on a crib mattress, which sleeping position is recommended by child health experts for the prevention of SIDS. The pocket is preferably substantially the same size as the end of the crib mattress to be covered, so as to fit securely and resist displacement or disengagement from the crib mattress in the course of ordinary sleeping patterns.

According to FIGS. 2A–2B, a preferred embodiment of the crib safety sack 1 further comprises at least one opening flap 5. The flap comprises a slit 6 extending lengthwise from the open top edge of the sack 7 to the closed bottom edge 8 of the sack 1. The two overlapping edges of the slit 6 are resealably closeable by a fastening means 9, such as one or more pairs of strips of Velcro® hook and loop tape 9. The fastening means preferably allows for a range of closed sizes, allowing the sack to be extended to accommodate a growing child. The crib safety sack 1 may comprise two flaps 5 on opposite panels of the sack 1, such as the top 2 and bottom 2' panels.

FIG. 2B shows the flap 5 in closed position with the two edges of the slit 6 sealed shut.

FIG. 3 shows the crib safety sack 1 on a crib mattress 10. The crib safety sack 1 is preferably positioned toward a foot end 12 of the mattress 10, such as the bottom ⅓ to ½ of the mattress. To ensure a snug fit and adequate pressure on the infant to prevent rollover, the sack preferably has a pocket-shape and wraps entirely around the foot end of the mattress. The sack is preferably substantially the same size as the end of the crib mattress to be covered. For use on a standard size crib mattress, the dimensions of the sack may be approximately 6" by 28½" by 18". It is not intended, however, to exclude sacks designed for smaller mattresses (such as, bassinet mattresses) or larger mattresses.

The crib safety sack 1 is reversible around the end of the mattress 10. A horizontal axis is defined from the head end 11 to the foot end 12 of the mattress. The crib safety sack 1 can be tugged around the axis, thus reversing the relative top 2 and bottom 2' panels of the crib safety sack 1 on the mattress 10. Alternatively, the sack 1 can be removed and replaced in the reverse position, or the entire mattress 10 with the sack 1 in place can be turned over, achieving the same effect. The advantage of reversibility is that the crib safety sack 1 provides extended wear over standard blankets between washings. A wet or soiled side of the sack 1 can be turned over to reveal a dry and fresh side ready for use.

Figure 4:
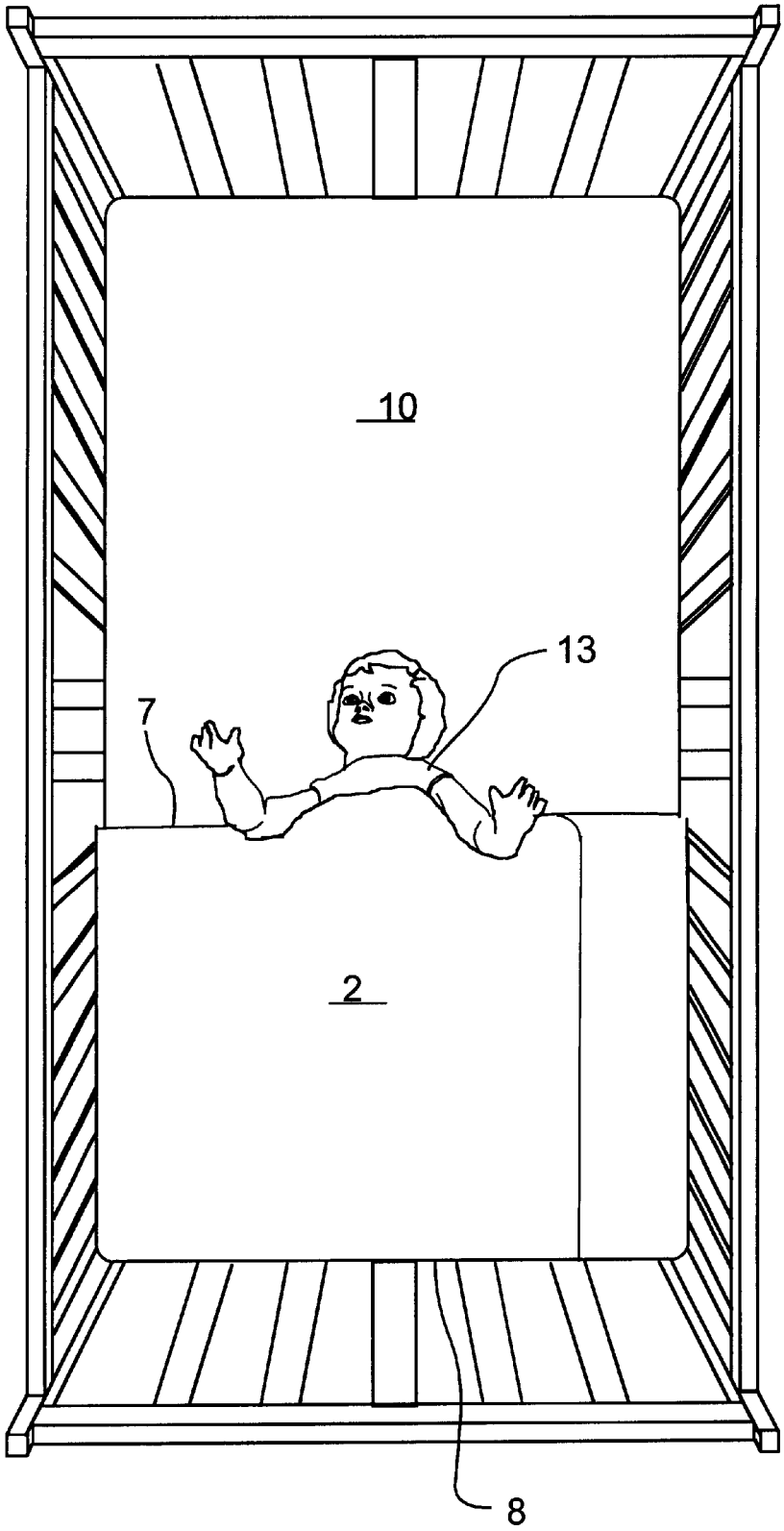
FIG. 4 is a top plan view of a crib safety sack in use on a crib mattress positioned in a crib.
Figure 5:
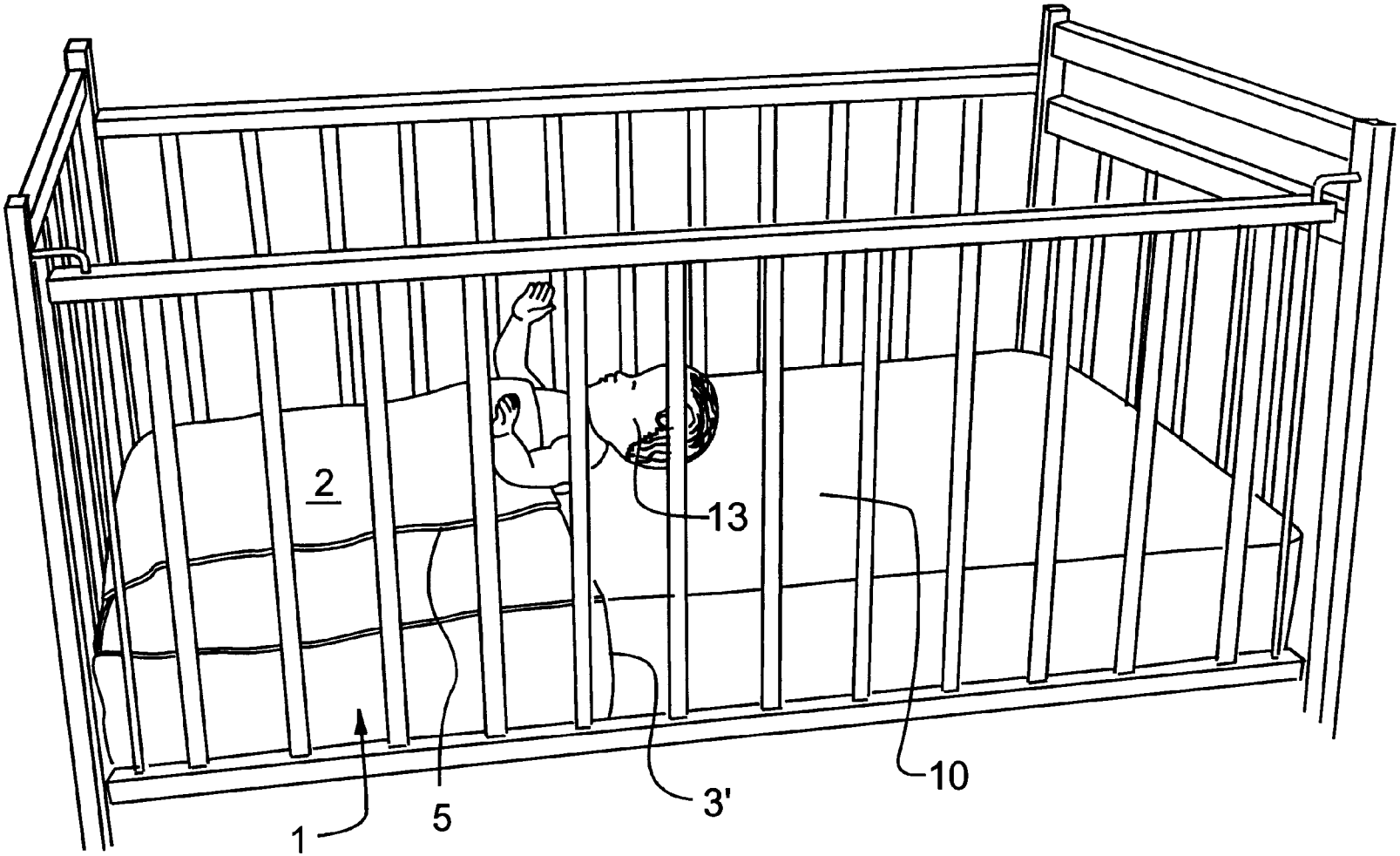
FIG. 5 is a side perspective view of the crib safety sack in use on a crib mattress in a crib.

FIGS. 4 and 5 show the crib safety sack 1 in use on a crib mattress 10 within a crib. The top panel 2 of the crib safety sack 1 exerts a gentle pressure on the infant 13 enclosed within to prevent the infant 13 from rolling over. The infant 13 is preferably tucked under the top panel of the sack, so as to lie in a back sleeping position on the surface of the crib mattress 10. The infant's 13 lower body is secured within the crib safety sack 1, while the infant's 13 head, shoulders and arms remain exposed.

The foregoing is considered as illustrative only of the principles of the invention. Further, since numerous modifications and changes will readily occur to those skilled in the art, it is not desired to limit the invention to the exact construction and applications shown and described, and accordingly, all suitable modifications and equivalents may be resorted to, falling within the scope of the invention and the appended claims and their equivalents.

All publications, patents and patent applications are incorporated by reference in their entirety to the same extent as if each individual publication, patent or patent application was specifically and individually indicated to be incorporated by reference in its entirety.

REFERENCES

American Academy of Pediatrics (2000). Policy Statement: Changing Concepts of Sudden Infant Death Syndrome: Implications for Infant Sleeping Environment and Sleep Position. Pediatrics 105, 650–56.

Canadian Paediatric Society et al. (1999). Reducing the Risk of Sudden Infant Death Syndrome in Canada: Joint Statement of the Canadian Foundation for the Study of Infant Deaths, the Canadian Institute of Child Health, the Canadian Paediatric Society and Health Canada. Paediatrics & Child Health 4(3), 223–4.

Health Canada (March 1998). Crib Safety Information Sheet.

National Institutes of Health (1998). News Alert: SIDS Rate Drops as More Babies are Placed to Sleep on their Backs or Sides.

US Consumer Product Safety Commission. Soft Bedding May Be Dangerous to Babies.

US Consumer Product Safety Commission. Crib Safety Tips.

I claim:

1. A crib safety sack for securing an infant in a back sleeping position on a crib mattress, comprising a fabric sack including a top panel fastened to a bottom panel so as to form a pocket with the crib mattress, the pocket adapted to fit securely over part of the infant lying proximate to an end of the crib mattress, the top panel exerting force on the infant so as to prevent rollover, wherein the sack comprises at least one opening flap, comprising a slit extending lengthwise from an open top edge of the sack to a closed bottom edge of the sack, wherein two overlapping edges of the slit are resealably closable by an adjustable fastener, the fastener adjusting to vary the cross-sectional dimensions of the pocket.

2. The crib safety sack according to claim 1, wherein the top panel is fastened to the bottom panel on three sides by two downwardly extending side panels and a downwardly extending foot panel.

3. The crib safety sack according to claim 1, wherein the sack comprises a stretchable fabric.

4. The crib safety sack according to claim 1, wherein the sack comprises a fleece fabric.

5. The crib safety sack according to claim 1, wherein the sack comprises a pocket substantially the same size as the end of the crib mattress to be covered.

6. The crib safety sack according to claim 1, wherein the fastener comprises hook and loop tape.

7. The crib safety sack according to claim 1, wherein the sack comprises two opening flaps, positioned on opposite panels of the sack.

8. The crib safety sack according to claim 1, wherein the crib mattress defines a horizontal axis from a head end to a foot end of the crib mattress and the sack is rotatably reversible about the axis around the foot end of the crib mattress, so as to reverse the relative position of the top and bottom panels.

9. A method of securing an infant in a back sleeping position on a crib mattress, comprising:

(a) covering an end of a crib mattress with a crib safety sack, comprising at least one opening flap, the at least one opening flap comprising a slit extending from an open top edge of the sack to a closed bottom edge of the sack, wherein two overlapping edges of the slit are resealably closeable by an adjustable fastener, the fastener adjusting to vary the cross-sectional dimensions of the pocket; and (b) tucking a foot end of an infant between a top panel of the crib safety sack and a top surface of the crib mattress; and (c) closing the slit using the fastener, wherein pressure is exerted on the infant preventing rollover and the infant is secured on the infant's back with the infant's head, shoulders and arms remaining exposed.

10. A method securing an infant in a back sleeping position on a crib mattress, comprising;

(a) opening at least one flap on a crib safety sack, comprising at least one opening flap, the at least one opening flap comprising a slit extending from an open top edge of the sack to a closed bottom edge of the sack, wherein two overlapping edges of the slit are resealably closeable by an adjustable fastener, the fastener adjusting to vary the cross-sectional dimensions of the pocket;

(b) covering an end of a crib mattress with the crib safety sack;

(c) tucking a foot end of an infant between a top panel of the crib safety sack and a top surface of the crib mattress; and (d) closing the at least one flap securing the infant on the infant's back under the top panel of the crib safety sack, so that pressure is exerted by the top panel on the infant preventing rollover and the infant is secured on the infant's back with the infant's head, shoulders and arms remaining exposed.

* * * * *